US008556608B2

(12) United States Patent
Sakakihara

(10) Patent No.: US 8,556,608 B2
(45) Date of Patent: Oct. 15, 2013

(54) ROTOR DRIVE MECHANISM AND PUMP APPARATUS INCLUDING THE SAME

(75) Inventor: Noriaki Sakakihara, Shiga (JP)

(73) Assignee: Heishin Ltd, Hyogo (JP)

( * ) Notice: Subject to any disclaimer, the term of this patent is extended or adjusted under 35 U.S.C. 154(b) by 103 days.

(21) Appl. No.: 13/258,134

(22) PCT Filed: Mar. 18, 2010

(86) PCT No.: PCT/JP2010/001946

§ 371 (c)(1),
(2), (4) Date: Nov. 2, 2011

(87) PCT Pub. No.: WO2010/113410

PCT Pub. Date: Oct. 7, 2010

(65) Prior Publication Data

US 2012/0039734 A1 Feb. 16, 2012

(30) Foreign Application Priority Data

Mar. 31, 2009 (JP) ..... 2009-085183

(51) Int. Cl.

| | |
|---|---|
| ***F01C 17/00*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/182; 418/48; 418/104; 277/634; 277/636

(58) Field of Classification Search

USPC ..... 418/48, 104, 182; 277/634–636, 911

See application file for complete search history.

(56) References Cited

U.S. PATENT DOCUMENTS

| | | | | | |
|---|---|---|---|---|---|
| 2,898,087 | A | * | 8/1959 | Clark | 418/48 |
| 4,140,444 | A | * | 2/1979 | Allen | 418/48 |
| 4,201,391 | A | * | 5/1980 | Bankstahl | 277/636 |
| 4,591,322 | A | * | 5/1986 | Ono et al. | 418/48 |
| 5,549,464 | A | * | 8/1996 | Varadan | 418/48 |
| 2007/0253852 | A1 | * | 11/2007 | Weber | 418/45 |

FOREIGN PATENT DOCUMENTS

| | | | |
|---|---|---|---|
| JP | 60142078 | A | 7/1985 |
| JP | 2001271764 | A | 5/2001 |
| JP | 2008186146 | A | 8/2008 |

* cited by examiner

*Primary Examiner* — Theresa Trieu

(74) *Attorney, Agent, or Firm* — The Ollila Law Group LLC

(57) ABSTRACT

A rotor drive mechanism 25 is configured to transfer rotation of a driving shaft 38 to an external screw type rotor 22 of a uniaxial eccentric screw pump 23 via a connecting shaft 39, the driving shaft 38 being rotated such that the center thereof is located at a fixed position. The rotor drive mechanism 25 is configured such that: the driving shaft 38 includes an inner space 46 which is open toward the rotor 22; the connecting shaft 39 is inserted in the inner space 46; and a first seal portion 55 seals between an inner peripheral surface of an opening of the driving shaft 38, the opening being open toward the rotor 22, and an outer peripheral surface of the rotor shaft 37 connected to the rotor 22 configured to carry out an eccentric rotational movement.

8 Claims, 6 Drawing Sheets

(b)

(a)

(b)

(a)

ROTOR DRIVE MECHANISM AND PUMP APPARATUS INCLUDING THE SAME

TECHNICAL FIELD

The present invention relates to a rotor drive mechanism applicable to a uniaxial eccentric screw pump capable of transferring various fluids, such as gases, liquids, and powder, and a pump apparatus including the rotor drive mechanism.

BACKGROUND ART

One example of conventional pump apparatuses will be explained in reference to FIG. 6. As shown in FIG. 6, a pump apparatus 1 includes a uniaxial eccentric screw pump 2 and a rotor drive mechanism 4 configured to rotate a rotor 3 provided in the uniaxial eccentric screw pump 2. The uniaxial eccentric screw pump 2 is configured such that the external screw type rotor 3 is fittingly inserted in an internal screw type inner hole 5*a* of a stator 5. By rotating the rotor 3 in a predetermined direction, a transfer fluid, such as a liquid, can be suctioned from a suction port 6 for example, held in a space between the rotor 3 and the stator 5, transferred, and then discharged from a discharge port 7. At this time, the rotor 3 carries out an eccentric rotational movement, i.e., rotates while carrying out a revolution movement about a central axis 8 of the stator inner hole 5*a* shown in FIG. 6. The rotor drive mechanism 4 realizes the eccentric rotational movement of the rotor 3.

The rotor drive mechanism 4 shown in FIG. 6 includes a driving shaft 9 rotated by a rotary driving portion (for example, an electric motor) 11 and a connecting shaft 10 connected to a tip end portion of the driving shaft 9. A tip end portion of the connecting shaft 10 is connected to a rear end portion (base end portion) of the rotor 3.

To be specific, when a rotating shaft 11*a* of the rotary driving portion 11 rotates, this rotation is transferred through a coupling 18, the driving shaft 9, and the connecting shaft 10 to the rotor 3, and thus, the rotor 3 carries out the eccentric rotational movement. With this, the transfer fluid can be suctioned from the suction port 6 and discharged from the discharge port 7.

As shown in FIG. 6, the tip end portion of the connecting shaft 10 and the rear end portion of the rotor 3 are connected to each other via a first joint portion (universal joint) 12, and the tip end portion of the driving shaft 9 and a rear end portion of the connecting shaft 10 are connected to each other via a second joint portion (universal joint) 13. The first and second joint portions 12 and 13 and the connecting shaft 10 are covered with a joint cover 14 made of, for example, synthetic rubber. The joint cover 14 prevents the transfer fluid, suctioned from the suction port 6 to a fluid accommodating space 16 of a casing 15, from contacting the first and second joint portions 12 and 13 and the connecting shaft 10.

Another example of the pump apparatus 1 is disclosed in PTL 1.

CITATION LIST

Patent Literature

PTL 1: Japanese Laid-Open Patent Application Publication No. 2001-271764

SUMMARY OF INVENTION

Technical Problem

However, in the conventional pump apparatus 1 shown in FIG. 6, the second joint portion 13, the connecting shaft 10, and the first joint portion 12 are connected to the tip end portion of the driving shaft 9, and the driving shaft 9, the second joint portion 13, and the like are arranged in series. Therefore, the total of longitudinal lengths of the driving shaft 9, the second joint portion 13, the connecting shaft 10, and the first joint portion 12 is a factor for an increase in the entire length of the pump apparatus 1.

To be specific, the pump apparatus 1 shown in FIG. 6 is used as, for example, a dispenser. For example, such dispenser may be attached to a tip end portion of a robot hand and used for an application work of applying a liquid to an inner surface of a narrow space. To improve workability, there is a need for a reduction in size of the dispenser used in such application work.

As shown in FIG. 6, the connecting shaft 10 and the first and second joint portions 12 and 13, covered with the joint cover 14, are arranged in the fluid accommodating space 16 of the casing 15. Therefore, the fluid accommodating space 16 increases in volume by the lengths of these components 10, 12, and 13. This increases the amount of transfer fluid accommodated in the fluid accommodating space 16 having a large volume. When washing the pump apparatus 1, the transfer fluid accommodated in the fluid accommodating space 16 is discarded. Therefore, there is a need for a reduction in the amount of transfer fluid to be discarded. To be specific, since some of transfer fluids are expensive, a reduction in the loss of the transfer fluid is an important object.

In a state where the driving shaft 9 shown in FIG. 6 rotates, and the transfer fluid is discharged from the discharge port 7, the rotor 3 receives a force in an axial direction by a discharge pressure (reaction force) of the transfer fluid. At this time, since the connecting shaft 10 is inclined with respect to the axial direction, a bending force (moment) is applied to the tip end portion of the driving shaft 9 in a direction perpendicular to the axial direction. The driving shaft 9 bends by this bending force, and this causes axial runout. The axial runout is a factor for a decrease in life of a seal portion 17 configured to seal a gap between the driving shaft 9 and an inner peripheral surface of the casing 15. There is a need for a reduction in maintenance cost of the shaft seal portion 17 and a reduction in work.

The present invention was made to solve the above problems, and an object of the present invention is to provide a rotor drive mechanism capable of reducing the longitudinal size of the pump apparatus and the volume of the fluid accommodating space of the casing and increasing the life of the seal portion, and the pump apparatus including the rotor drive mechanism.

Solution to Problem

A rotor drive mechanism according to a first aspect of the present invention is configured to transfer rotation of a driving shaft to an external screw type rotor of a uniaxial eccentric screw pump via a connecting shaft, the driving shaft being rotated such that a center thereof is located at a fixed position, wherein: the driving shaft includes an inner space which is open toward the rotor, and the connecting shaft is inserted in the inner space; a base end portion of the connecting shaft is connected to the driving shaft, and a tip end portion of the connecting shaft is connected to the rotor; and a first seal portion seals between an inner peripheral surface of an opening of the driving shaft, the opening being open toward the rotor, and an outer peripheral surface of a base end portion of the rotor configured to carry out an eccentric rotational movement or between the inner peripheral surface of the opening of the driving shaft and an outer peripheral surface of the connecting shaft.

In accordance with the rotor drive mechanism of the first aspect of the present invention, the connecting shaft can be used by being connected to the external screw type rotor of the uniaxial eccentric screw pump. To be specific, when the driving shaft is rotated in a predetermined direction, the rotation of the driving shaft can be transferred to the rotor via the connecting shaft to cause the rotor to carry out the eccentric rotational movement. By the eccentric rotational movement of the rotor, a space formed by an inner surface of the stator inner hole and an outer surface of the rotor moves in a direction from one opening of the stator inner hole toward the other opening. Therefore, the transfer fluid can be transferred in this direction.

The connecting shaft is inserted in the inner space of the driving shaft, and the base end portion of the connecting shaft is connected to the driving shaft. Therefore, the axial length of the rotor drive mechanism can be shortened by the overlap of the connecting shaft and the driving shaft. The first seal portion seals between the inner peripheral surface of the opening of the driving shaft and the outer peripheral surface of the base end portion of the rotor or between the inner peripheral surface of the opening of the driving shaft and the outer peripheral surface of the connecting shaft. Therefore, it is possible to prevent the transfer fluid from flowing into the inner space of the driving shaft, and the volume of the fluid accommodating space in the casing can be reduced by the volume of the inner space. The first seal portion seals the inner space of the driving shaft to prevent the transfer fluid from flowing into the inner space. Therefore, the connecting shaft inserted in the sealed inner space can be prevented from contacting the transfer fluid. On this account, it is possible to prevent a case where when the connecting shaft is rotated by the driving shaft to whirl, the whirling of the connecting shaft is inhibited by the transfer fluid.

The rotor drive mechanism according to a second aspect of the present invention is configured such that in the first aspect of the present invention, the tip end portion of the connecting shaft and the rotor are connected to each other via a first joint portion, the base end portion of the connecting shaft and the driving shaft are connected to each other via a second joint portion, and the first and second joint portions and the connecting shaft are arranged in the inner space of the driving shaft, the inner space being sealed by the first seal portion.

For example, a joint including a universal joint can be used as each of the first and second joint portions. The first seal portion can prevent the first and second joint portions and the connecting shaft from contacting the transfer fluid. With this, for example, even if the transfer fluid has corrosivity, the material of each of the first and second joint portions and the connecting shaft does not have to be selected from corrosion-resistance materials, and an appropriate material, such as a high-strength material, can be freely selected. Further, since it is unnecessary to consider adaptability between the transfer fluid and the material of each of the first and second joint portions and the connecting shaft, it is possible to widen the range of use of the transfer fluid which can be transferred by the uniaxial eccentric screw pump.

The rotor drive mechanism according to a third aspect of the present invention is configured such that in the first aspect of the present invention, the base end portion of the connecting shaft and the driving shaft are connected to each other via a third joint portion, and the third joint portion and the connecting shaft are arranged in the inner space of the driving shaft, the inner space being sealed by the first seal portion.

A joint including an eccentric joint, such as Oldham coupling, can be used as the third joint portion. The first seal portion can prevent the third joint portion and the connecting shaft from contacting the transfer fluid. With this, for example, even if the transfer fluid has corrosivity, the material of each of the third joint portion and the connecting shaft does not have to be selected from corrosion-resistance materials, and an appropriate material, such as a high-strength material, can be freely selected. Further, it is unnecessary to consider the adaptability between the transfer fluid and the material of each of the third joint portion and the connecting shaft, and it is possible to widen the range of use of the transfer fluid which can be transferred by the uniaxial eccentric screw pump.

The rotor drive mechanism according to a fourth aspect of the present invention is configured such that the second joint portion of the second aspect of the present invention or the third joint portion of the third aspect of the present invention is arranged on a radially inward side of a bearing portion configured to rotatably support the driving shaft.

With this, in a state where the driving shaft rotates, and the transfer fluid is discharged from the discharge port of the uniaxial eccentric screw pump, the rotor receives a force in an axial direction by the discharge pressure (reaction force) of the transfer fluid. At this time, since the connecting shaft is inclined with respect to the axial direction, the bending force (moment) is applied to a portion of the driving shaft in a direction perpendicular to the axial direction, the portion being connected by the second joint portion or the third joint portion. However, since the second joint portion or the third joint portion is arranged on a radially inward side of the bearing portion which rotatably supports the driving shaft, it is possible to prevent the axial runout of the driving shaft by the bending force. With this, it is possible to prevent the occurrence of the vibration of the rotor drive mechanism and lengthen the life of the rotor drive mechanism.

The rotor drive mechanism according to a fifth aspect of the present invention is configured such that in the fourth aspect of the present invention, a second seal portion seals between an outer peripheral surface of the opening of the driving shaft, the opening being open toward the rotor, and an inner peripheral surface of a casing of the uniaxial eccentric screw pump.

With this, since the second seal portion seals a gap between the outer peripheral surface of the driving shaft and the inner peripheral surface of the casing, it is possible to prevent the transfer fluid in the casing from flowing into a space located on the bearing side. Thus, the volume of the fluid accommodating space in the casing can be reduced. Since the axial runout of the driving shaft is prevented, the vibration by the axial runout is not applied to the second seal portion. As a result, it is possible to prevent the life of the second seal portion from being shortened by the axial runout of the driving shaft and lengthen the life of the rotor drive mechanism.

The rotor drive mechanism according to a sixth aspect of the present invention is configured such that in the second aspect of the present invention, each of the first and second joint portions is a universal joint.

With this, the rotation of the driving shaft can be smoothly transferred to the rotor to cause the rotor to accurately carry out the eccentric rotational movement, and the accuracy of the discharge rate of the uniaxial eccentric screw pump can be improved.

The rotor drive mechanism according to a seventh aspect of the present invention is configured such that in the first aspect of the present invention, the connecting shaft is a flexible rod.

With this, the configuration of the rotor drive mechanism can be simplified, and the rotor drive mechanism can be reduced in size, weight, and cost.

A pump apparatus according to an eighth aspect of the present invention is configured to include the rotor drive mechanism of the first aspect of the present invention and the uniaxial eccentric screw pump.

In accordance with the pump apparatus of the eighth aspect of the present invention, the effects explained for the rotor drive mechanism are achieved.

Advantageous Effects of Invention

In accordance with the rotor drive mechanism and pump apparatus of the present invention, the axial length of the rotor drive mechanism can be shortened. Therefore, the axial length of the pump apparatus to which the rotor drive mechanism is applied can be shortened, and the pump apparatus can be reduced in size and weight. For example, in a case where the pump apparatus to which the rotor drive mechanism is applied is attached as a dispenser to a tip end portion of a robot hand and used for an application work of applying a liquid to an inner surface of a narrow space, the workability can be improved.

Since the inner space of the driving shaft is sealed by the first seal portion, and the volume of the fluid accommodating space in the casing is reduced, the amount of transfer fluid, which is accommodated in the fluid accommodating space and is discarded when, for example, washing the pump apparatus, can be reduced, which is economical.

The inner space of the driving shaft is sealed by the first seal portion to prevent the transfer fluid from flowing into the inner space. Therefore, it is possible to prevent a case where when the connecting shaft inserted in the inner space is rotated to whirl, the whirling of the connecting shaft is inhibited by the transfer fluid. With this, the accuracy of the discharge rate of the uniaxial eccentric screw pump driven by the rotor drive mechanism can be improved.

BRIEF DESCRIPTION OF DRAWINGS

FIG. 3(*a*) is an A-A enlarged longitudinal sectional view. FIG. 3(*b*) is an enlarged rear view.

FIG. 4(*a*) is a B-B enlarged longitudinal sectional view. FIG. 4(*b*) is an enlarged rear view.

DESCRIPTION OF EMBODIMENTS

Next, Embodiment 1 of a rotor drive mechanism according to the present invention and a pump apparatus including the rotor drive mechanism will be explained in reference to FIGS. 1 to 3. A pump apparatus 21 can cause a rotor 22 shown in FIG. 1 to rotate and carry out a revolution movement along a predetermined path (to carry out an eccentric rotational movement). With this, the pump apparatus 21 can transfer and supply any fluids, such as low to high viscous fluids, with high flow rate accuracy and a long operating life.

Figure 1:
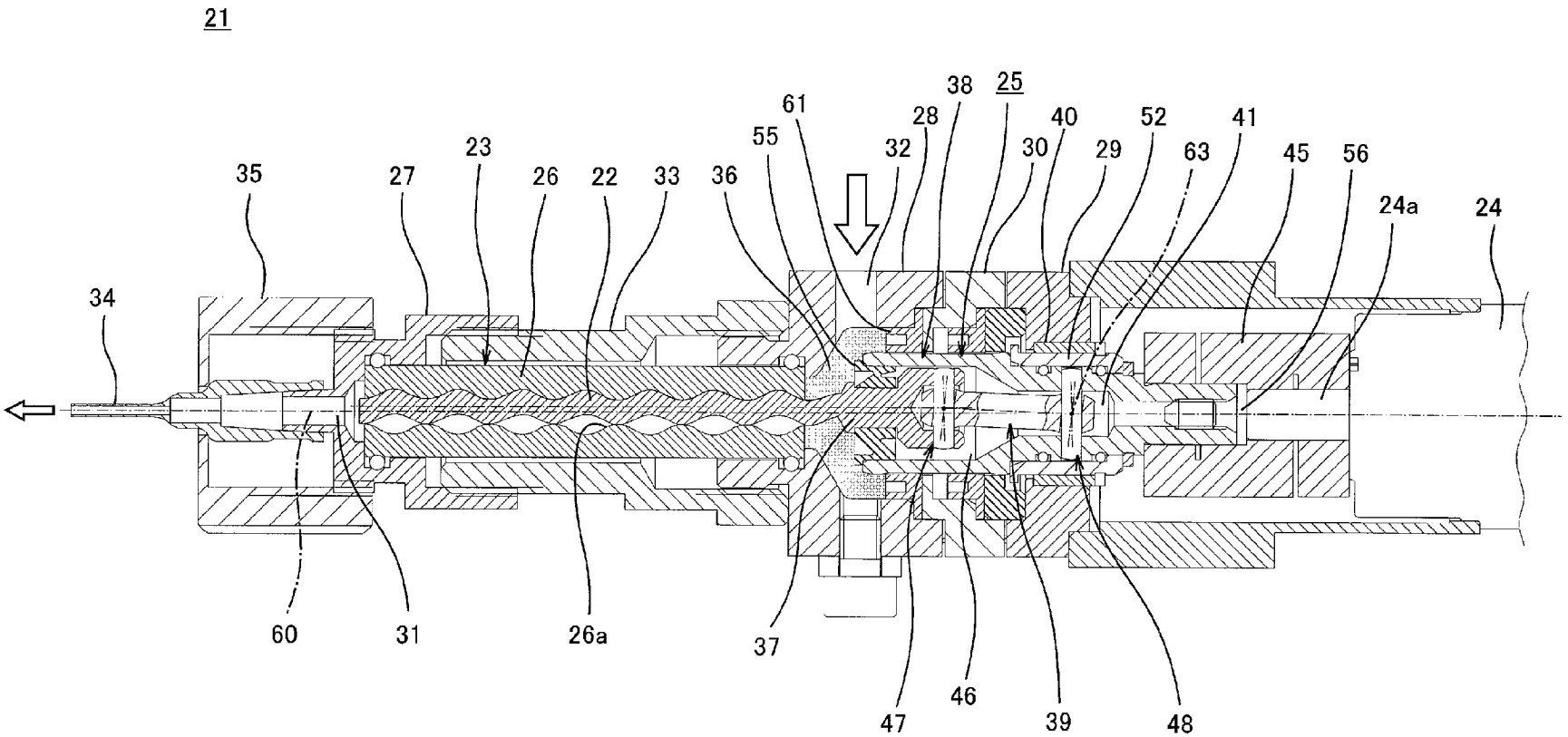
FIG. 1 is a longitudinal sectional view showing a pump apparatus according to Embodiment 1 of the present invention.

As shown in FIG. 1, the pump apparatus 21 includes a uniaxial eccentric screw pump 23, a rotary driving portion 24, and a rotor drive mechanism 25.

The uniaxial eccentric screw pump 23 is a rotary volume type pump and includes an internal screw type stator 26 and the external screw type rotor 22.

As shown in FIG. 1, the stator 26 is formed to have a substantially short cylindrical shape having an inner hole 26*a* of a double thread internal screw shape for example. A longitudinal cross-sectional shape of the inner hole 26*a* is elliptical. The stator 26 is made of, for example, a rubber-like elastic body, such as synthetic rubber, or engineering plastic, such as fluorocarbon resin. The stator 26 is attached to be sandwiched between a nozzle 27 and an end portion of a first casing 28. The nozzle 27 has a first opening 31, and the first casing 28 has a second opening 32. An outer tube 33 is attached to between the nozzle 27 and the first casing 28.

As shown in FIG. 1, a needle nozzle 34 is attached to a tip end portion of the nozzle 27 and fastened to the nozzle 27 by a nut 35.

The first opening 31 can be used as a discharge port (or a suction port), and the second opening 32 can be used as a suction port (or a discharge port). The first opening 31 communicates with a tip end opening of the inner hole 26*a* of the stator 26, and the second opening 32 communicates with a rear end opening of the inner hole 26*a*. A fluid accommodating space 36 is formed between the second opening 32 and the rear end opening of the inner hole 26*a*.

As shown in FIG. 1, the rotor 22 is formed to have a single thread external screw shape for example. A longitudinal cross-sectional shape of the rotor 22 is a substantially perfect circle. A pitch of a spiral shape of the rotor 22 is set to half a pitch of the stator 26. The rotor 22 is made of a metal, such as stainless steel, and is fittingly inserted in the inner hole 26*a* of the stator 26. A rotor shaft 37 is formed at a rear end portion (base end portion) of the rotor 22. The rotor shaft 37 is included in the rotor drive mechanism 25.

Figure 2:
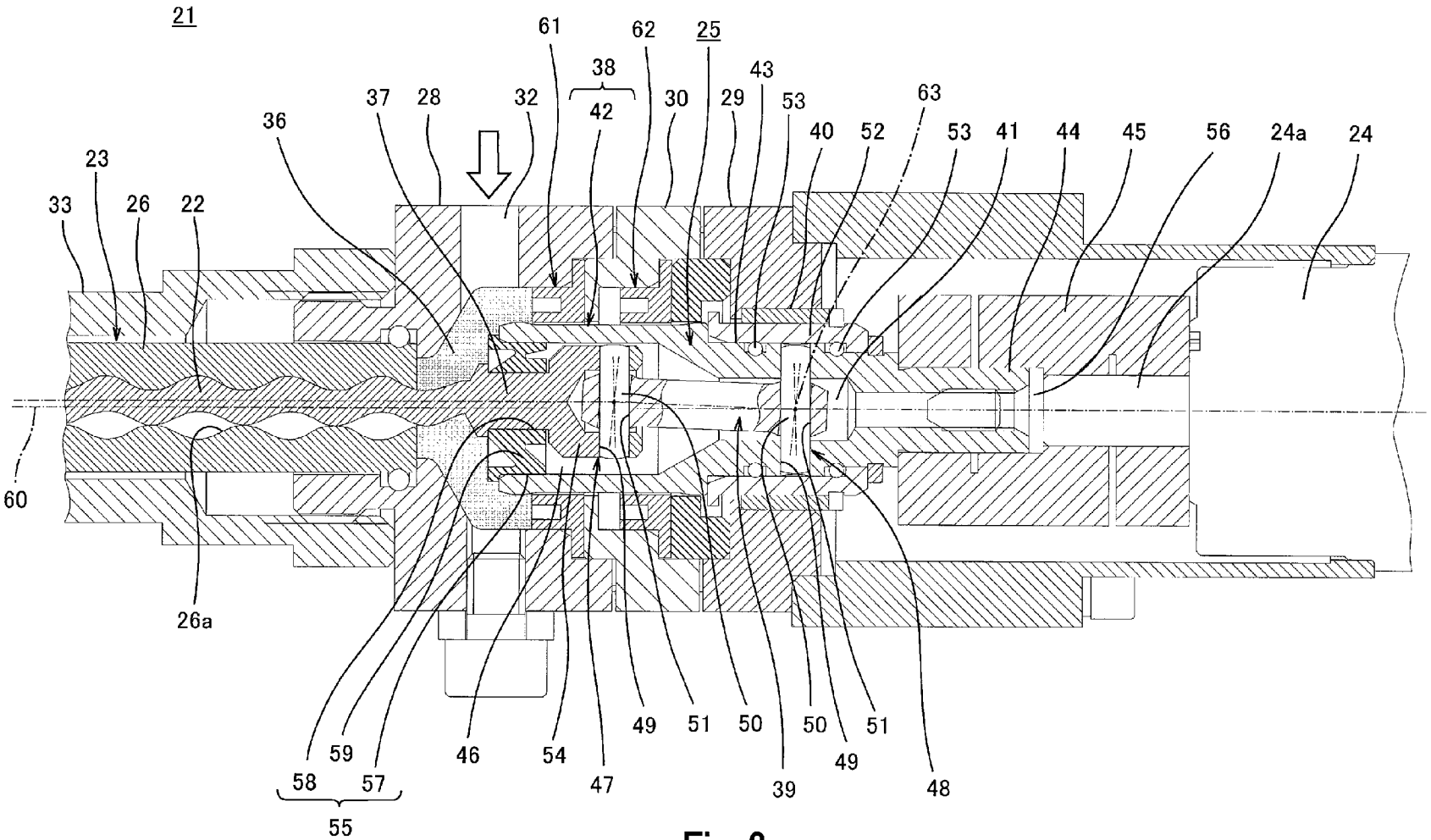
FIG. 2 is a partially enlarged cross-sectional view showing a rotor drive mechanism included in the pump apparatus according to Embodiment 1.

As shown in FIG. 2, the rotor drive mechanism 25 is configured to transfer the rotation of a rotating shaft 24*a*, rotated by the rotary driving portion 24, to the external screw type rotor 22 of the uniaxial eccentric screw pump 23. The rotor drive mechanism 25 includes a driving shaft 38, a connecting shaft 39, and the rotor shaft 37.

As shown in FIG. 2, the driving shaft 38 is rotatably provided on an inner surface of a second casing 29 via a bearing portion 40, such as a slide bearing. The driving shaft 38 is a tubular member having a center hole 41. The driving shaft 38 includes a large-diameter portion 42 at a tip end portion thereof, an intermediate-diameter portion 43 at a center portion thereof, and a small-diameter portion 44 at a rear end portion thereof. The small-diameter portion 44 at the rear end portion of the driving shaft 38 is connected to the rotating shaft 24*a* of the rotary driving portion 24 by a coupling 45.

An inner space 46 is formed inside the large-diameter portion 42 of the tip end portion of the driving shaft 38 so as to open toward the rotor 22. The connecting shaft 39 is inserted into the center hole 41 including the inner space 46.

As shown in FIG. 2, the connecting shaft 39 is a rod-shaped body having a predetermined length. A rear end portion of the connecting shaft 39 is provided at the center hole 41 formed inside the intermediate-diameter portion 43 of the driving shaft 38, and a tip end portion of the connecting shaft 39 is provided at the inner space 46 formed inside the large-diameter portion 42 of the driving shaft 38.

Further, the tip end portion of the connecting shaft 39 is connected to the rotor shaft 37 via a first joint portion 47, and the rear end portion of the connecting shaft 39 is connected to the intermediate-diameter portion 43 of the driving shaft 38 via a second joint portion 48. Each of the first and second joint portions 47 and 48 is, for example, a universal joint.

As shown in FIG. 2, the second joint portion 48 includes a pair of coupling holes 49, which are formed on a side wall of the tubular-shaped intermediate-diameter portion 43 to be opposed to each other in a radial direction. Both end portions of a connecting pin 50 are respectively attached to the pair of coupling holes 49. The connecting pin 50 is inserted through a connecting hole 51 formed at the rear end portion of the connecting shaft 39. The connecting hole 51 is formed to increase in diameter in an axial direction of the connecting shaft 39 as it extends toward each of two opening end portions of the connecting hole 51.

In accordance with the second joint portion 48 formed as above, the intermediate-diameter portion 43 of the driving shaft 38 and the rear end portion of the connecting shaft 39 are connected to each other such that: the connecting shaft 39 can swing about a shaft center of the connecting pin 50; and the tip end portion of the connecting shaft 39 can swing about a center of the connecting pin 50 in an upper-lower direction in FIG. 2.

Further, as shown in FIG. 2, a cylindrical seal cover 52 is attached to an outer peripheral surface of the intermediate-diameter portion 43 of the driving shaft 38. The seal cover 52 seals a lubricating liquid filled in the inner space 46 and center hole 41 of the driving shaft 38 and is arranged to cover the pair of coupling holes 49. Two O rings 53 are attached to the outer peripheral surface of the intermediate-diameter portion 43 so as to sandwich the pair of coupling holes 49 from both sides. An inner peripheral surface of the seal cover 52 configured as above and two O rings 53 seal the pair of coupling holes 49 to prevent the lubricating liquid, filled in the inner space 46 and center hole 41 of the driving shaft 38, from leaking through the pair of coupling holes 49 to the outside of the driving shaft 38.

The bearing portion 40 is attached to an outer peripheral surface of the seal cover 52. The driving shaft 38 and the seal cover 52 are rotatably supported by the bearing portion 40. To be specific, the connecting pin 50 of the second joint portion 48 is arranged on a radially inward side of the bearing portion 40.

Next, the first joint portion 47 will be explained. As shown in FIG. 2, the first joint portion 47 is similar to the second joint portion 48 and includes a connecting tubular portion 54 coupled to the rotor shaft 37. The connecting tubular portion 54 includes a pair of coupling holes 49, which are formed to be opposed to each other in the radial direction. Both end portions of a connecting pin 50 are respectively attached to the pair of coupling holes 49. The connecting pin 50 is inserted through a connecting hole 51 formed at the tip end portion of the connecting shaft 39. The connecting hole 51 is formed to increase in diameter in the axial direction of the connecting shaft 39 as it extends toward each of two opening end portions of the connecting hole 51.

In accordance with the first joint portion 47 formed as above, as with the second joint portion 48, the tip end portion of the connecting shaft 39 and the rotor shaft 37 are connected to each other such that: the connecting shaft 39 can swing about a shaft center of the connecting pin 50; and a cross angle (cross angle in a plane parallel to the sheet of FIG. 2) between a shaft center of the connecting shaft 39 and a shaft center of the rotor 22 is changeable.

As shown in FIG. 2, a first seal portion 55 is attached to an outer peripheral surface of the rotor shaft 37. The first seal portion 55 is made of a rubber-like elastic body, such as synthetic rubber. The first seal portion 55 seals between the outer peripheral surface of the rotor shaft 37 and an inner peripheral surface of an opening (large-diameter portion 42) of the driving shaft 38, the opening being open toward the rotor 22. The first seal portion 55 seals between the fluid accommodating space 36 formed in the first casing 28 and the inner space 46 and center hole 41 formed in the large-diameter portion 42, and thus, the first seal portion 55 separates the fluid accommodating space 36 from the inner space 46 and the center hole 41.

Further, as shown in FIG. 2, a rear end opening of the center hole 41 formed in the small-diameter portion 44 of the driving shaft 38 is sealed by a plug 56.

As above, the inner space 46 and center hole 41 formed inside the driving shaft 38 are sealed by the first seal portion 55 and the plug 56. The connecting shaft 39 and the first and second joint portions 47 and 48 are accommodated in the inner space 46 and the center hole 41, and the lubricating liquid is filled in the inner space 46 and the center hole 41.

Figure 3:
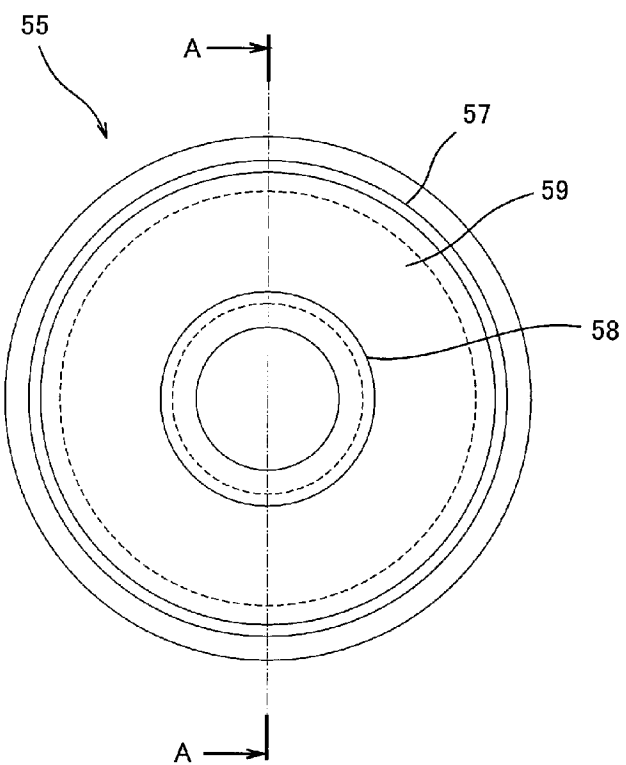
FIGS. 3(*a*) and 3(*b*) each shows a first seal portion attached to the rotor drive mechanism according to Embodiment 1.
Figure 3:
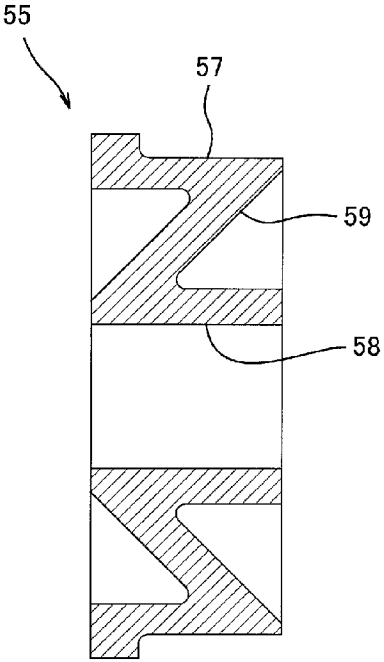

As shown in FIGS. 3(*a*) and 3(*b*), the first seal portion 55 is an annular-shaped member. A cross-sectional shape of the first seal portion 55 is a substantially Z shape. The first seal portion 55 includes an outer side wall portion 57, an inner side wall portion 58, and a connecting wall portion 59. An outer peripheral surface of the outer side wall portion 57 is formed to be slightly larger in diameter than the inner peripheral surface of the large-diameter portion 42 of the driving shaft 38 and is attached firmly to the inner peripheral surface of the large-diameter portion 42. An inner peripheral surface of the inner side wall portion 58 is formed to be slightly smaller in diameter than the outer peripheral surface of the rotor shaft 37 and is attached firmly to the outer peripheral surface of the rotor shaft 37. The connecting wall portion 59 has a substantially truncated cone shape and connects a rear end portion of the outer side wall portion 57 and a tip end portion of the inner side wall portion 58.

In accordance with the first seal portion 55, when the rotor shaft 37 carries out the eccentric rotational movement in accordance with the rotor 22, to be specific, when the rotor shaft 37 carries out the revolution movement while rotating about a central axis 60 of the inner hole 26*a* of the stator 26, as shown in FIG. 2, the first seal portion 55 deforms such that the inner side wall portion 58 can move in the radial direction, so that the rotor 22 can freely carry out the eccentric rotational movement, the transfer fluid in the fluid accommodating space 36 can be prevented from flowing into the inner space 46 and center hole 41 formed inside the driving shaft 38, and the lubricating liquid filled in the inner space 46 and the center hole 41 can be prevented from leaking to the fluid accommodating space 36.

Even in a state where the rotor 22 carries out the eccentric rotational movement, the first seal portion 55 does not rotate in accordance with the rotor 22 and is in a stationary state and attached firmly to the inner peripheral surface of the large-diameter portion 42 of the driving shaft 38.

As shown in FIG. 2, a second seal portion 61 is attached to an annular-shaped gap between an outer peripheral surface of the large-diameter portion 42 of the driving shaft 38 and an inner peripheral surface of the first casing 28. The second seal portion 61 seals this annular-shaped gap. The second seal portion 61 is made of engineering plastic, such as fluorocarbon resin or ultrahigh molecular weight polyethylene. The second seal portion 61 seals between the fluid accommodating space 36 formed in the first casing 28 and a space which is located on a rear side of the second seal portion 61 and accommodates the bearing portion 40, and thus, the second seal portion 61 separates the fluid accommodating space 36 from this space.

As shown in FIG. 2, the second seal portion 61 is an annular-shaped member. A cross-sectional shape of the second seal portion 61 is a substantially inverted C shape. An outer peripheral surface of the second seal portion 61 is formed to be slightly larger in diameter than the inner peripheral surface of the first casing 28 and is attached firmly to the inner peripheral surface of the first casing 28. An inner peripheral surface of the second seal portion 61 is formed to be slightly smaller in diameter than the outer peripheral surface of the large-diameter portion 42 of the driving shaft 38 and is attached firmly to the outer peripheral surface of the large-diameter portion 42.

In accordance with the second seal portion 61, the transfer fluid in the fluid accommodating space 36 of the first casing 28 can be prevented from flowing into a space located on the bearing portion 40 side, and foreign matters which may exist in the space located on the bearing portion 40 side can be prevented from getting into the fluid accommodating space 36.

As shown in FIG. 2, a third casing 30 is arranged between the first casing 28 and the second casing 29. A second seal portion 62 is attached to between an inner peripheral surface of the third casing 30 and the outer peripheral surface of the large-diameter portion 42 of the driving shaft 38. The second seal portion 62 is the same in configuration as the second seal portion 61 and acts in the same manner as the second seal portion 61, so that an explanation thereof is omitted.

Next, in accordance with the pump apparatus 21 including the rotor drive mechanism 25 configured as above, when the rotary driving portion 24 shown in FIG. 1 rotates, the rotation of the rotary driving portion 24 can be transferred through the rotating shaft 24*a*, the driving shaft 38, the second joint portion 48, the connecting shaft 39, the first joint portion 47, and the rotor shaft 37 to the rotor 22 of the uniaxial eccentric screw pump 23 to rotate the rotor 22 in a predetermined direction. Then, the rotor 22 carries out the eccentric rotational movement. Thus, the rotor 22 can cause a liquid, such as the transfer fluid, to flow into the pump apparatus 21 through the second opening 32 and to be discharged from the needle nozzle 34.

To be specific, by the eccentric rotational movement of the rotor 22, a space formed between an inner surface of the stator inner hole 26*a* and an outer surface of the rotor 22 moves in a direction from an opening, located on the second opening 32 side, of the stator inner hole 26*a* to an opening, located on the first opening 31 side, of the stator inner hole 26*a*, so that the transfer fluid can be transferred in this direction. At this time, the rotor 22 carries out the eccentric rotational movement, i.e., rotates while carrying out the revolution movement about the central axis 60 of the stator inner hole 26*a* shown in FIG. 2. The rotor drive mechanism 25 realizes the eccentric rotational movement of the rotor 22.

In accordance with the rotor drive mechanism 25 shown in FIG. 2, the connecting shaft 39 and the first and second joint portions 47 and 48 are arranged in the inner space 46 and center hole 41 of the driving shaft 38, and the rear end portion (base end portion) of the connecting shaft 39 is connected to the intermediate-diameter portion 43 of the driving shaft 38 via the second joint portion 48. Therefore, the axial length of the rotor drive mechanism 25, that is, the axial length of the pump apparatus 21 can be shortened by the overlap of the connecting shaft 39, the first and second joint portions 47 and 48, and the driving shaft 38. Thus, the pump apparatus 21 can be reduced in size and weight. For example, in a case where the pump apparatus 21 to which the rotor drive mechanism 25 is applied is attached as a dispenser to a tip end portion of a robot hand and used for an application work of applying a liquid to an inner surface of a narrow space, the workability can be improved.

As shown in FIG. 2, the first seal portion 55 seals a ring-shaped gap between the inner peripheral surface of the opening formed at the large-diameter portion 42 of the driving shaft 38 and the outer peripheral surface of the rotor shaft 37. Therefore, the transfer fluid can be prevented from flowing into the inner space 46 and center hole 41 of the driving shaft 38, and the volume of the fluid accommodating space 36 in the first casing 28 can be reduced by the volume of the inner space 46 and the center hole 41. On this account, the amount of transfer fluid, which is accommodated in the fluid accommodating space 36 and is discarded when, for example, washing the pump apparatus 21, can be reduced, which is economical.

The first seal portion 55 seals the inner space 46 and center hole 41 of the driving shaft 38 to prevent the transfer fluid from flowing into the inner space 46 and the center hole 41. Therefore, the connecting shaft 39 and first and second joint portions 47 and 48 inserted in the inner space 46 and the center hole 41 can be prevented from contacting the transfer fluid. On this account, it is possible to prevent a case where when the connecting shaft 39 and the first and second joint portions 47 and 48 are rotated by the driving shaft 38 to whirl, the whirling of the connecting shaft 39 and the first and second joint portions 47 and 48 is inhibited by the transfer fluid. With this, the accuracy of the discharge rate of the uniaxial eccentric screw pump 23 driven by the rotor drive mechanism 25 can be improved.

Further, as described above, the first and second joint portions 47 and 48 and the connecting shaft 39 can be prevented from contacting the transfer fluid. Therefore, for example, even if the transfer fluid has corrosivity, the material of each of the first and second joint portions 47 and 48 and the connecting shaft 39 does not have to be selected from corrosion-resistance materials, and an appropriate material, such as a high-strength material, can be freely selected. Then, it is unnecessary to consider adaptability between the transfer fluid and the material of each of the first and second joint portions 47 and 48 and the connecting shaft 39, and it is possible to widen the range of use of the transfer fluid which can be transferred by the uniaxial eccentric screw pump 23.

As shown in FIG. 2, when the driving shaft 38 rotates to cause the rotor 22 to carry out the eccentric rotational movement, a bending force (moment) is applied in a direction perpendicular to the axial direction to the intermediate-diameter portion 43 (radial load applied point 63) of the driving shaft 38 to which the second joint portion 48 is connected. However, since the second joint portion 48 is arranged on a radially inward side of the bearing portion 40 which rotatably supports the intermediate-diameter portion 43 of the driving shaft 38, it is possible to prevent axial runout of the driving shaft 38 by this bending force. Therefore, it is possible to prevent the occurrence of the vibration of the rotor drive mechanism 25 and lengthen the life of the rotor drive mechanism 25.

As shown in FIG. 2, the second seal portions 61 and 62 seal a ring-shaped gap between the outer peripheral surface of the large-diameter portion 42 of the driving shaft 38 and the inner peripheral surface of the first casing 28. Therefore, the transfer fluid in the first casing 28 can be prevented from flowing into the space located on the bearing portion 40 side. With this, the volume of the fluid accommodating space 36 can be reduced. As described above, since the axial runout of the driving shaft 38 is prevented, the vibration by the axial runout is not applied to the second seal portion 61. As a result, the life of the second seal portion 61 can be prevented from being shortened by the axial runout of the driving shaft 38.

Further, since the first and second joint portions 47 and 48 are universal joints, they can smoothly transfer the rotation of the driving shaft 38 to the rotor 22 to cause the rotor 22 to accurately carry out the eccentric rotational movement, and this can improve the accuracy of the discharge rate of the uniaxial eccentric screw pump 23.

Figure 5:
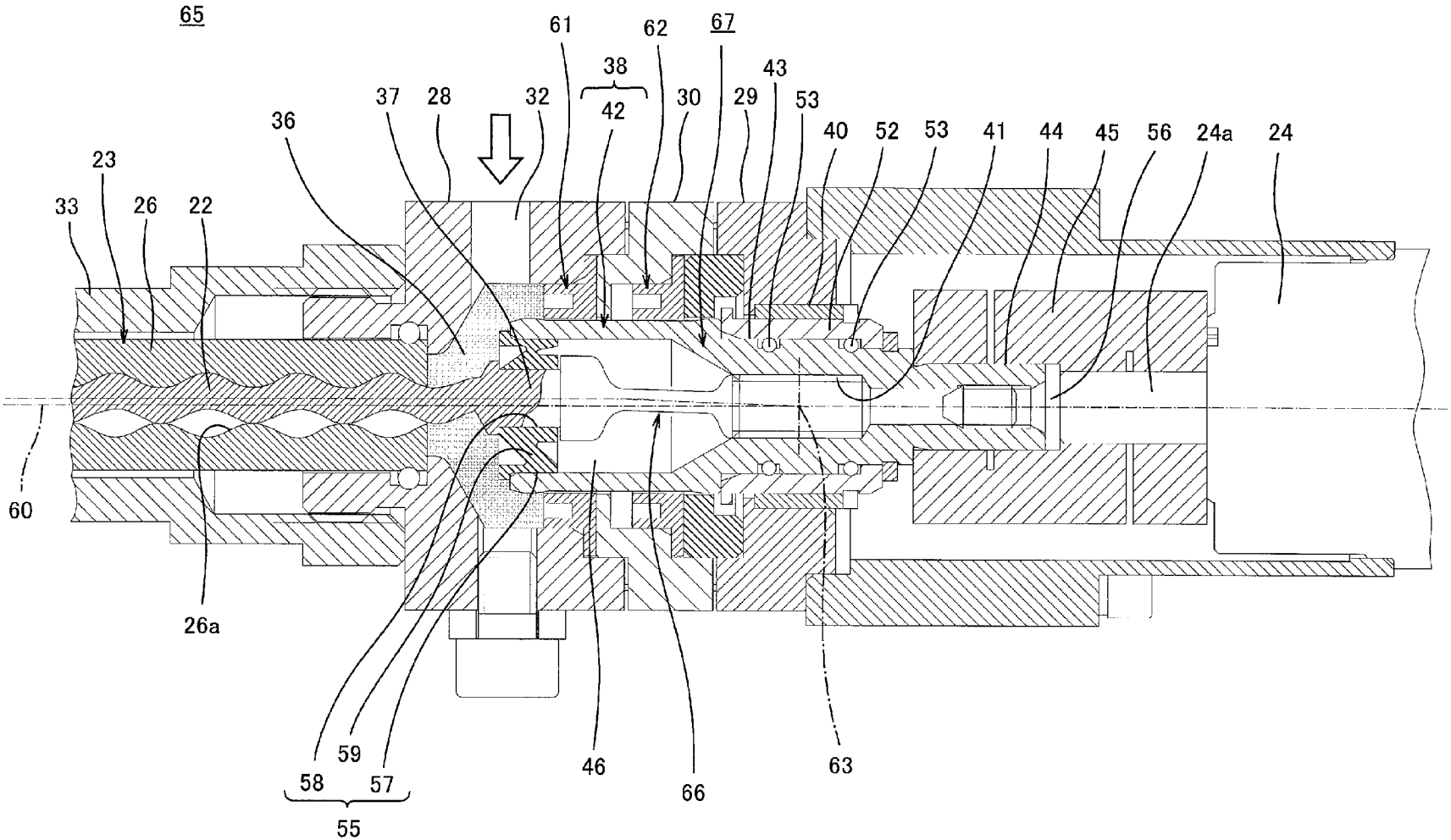
FIG. 5 is a partially enlarged cross-sectional view showing the rotor drive mechanism included in the pump apparatus according to Embodiment 2 of the present invention.
Figure 6:
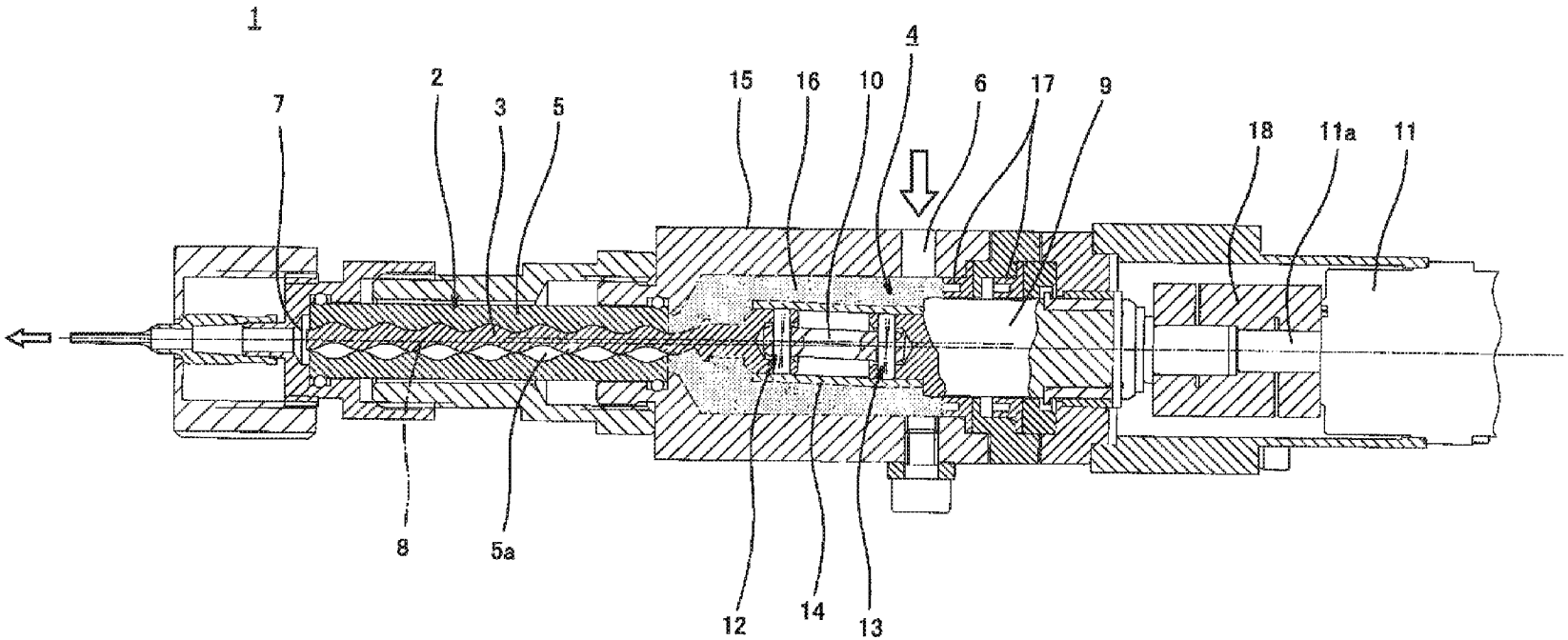
PRIOR ART Fig. 6
FIG. 6 is a longitudinal sectional view showing a conventional pump apparatus.

Next, Embodiment 2 of the pump apparatus including the rotor drive mechanism according to the present invention will be explained in reference to FIG. 5. A pump apparatus 65 of Embodiment 2 shown in FIG. 5 is different from the pump apparatus 21 of Embodiment 1 shown in FIG. 2 in that: in Embodiment 1 shown in FIG. 2, the driving shaft 38 and the rotor shaft 37 are connected to each other via the second joint portion 48, the connecting shaft 39, and the first joint portion 47; but in Embodiment 2 shown in FIG. 5, the driving shaft 38 and the rotor shaft 37 are connected to each other via a flexible rod 66. Other than the above, the pump apparatus of Embodiment 2 is the same as that of Embodiment 1 shown in FIGS. 1 and 2, so that the same reference signs are used for the same components, and explanations thereof are omitted.

As above, even in a case where the driving shaft 38 and the rotor shaft 37 are connected to each other via the flexible rod 66, it is possible to cause the rotor 22 to carry out the eccentric rotational movement and discharge the transfer fluid from the needle nozzle 34 as with Embodiment 1.

As shown in FIG. 5, a connection portion where a rear end portion (base end portion) of the flexible rod 66 and the intermediate-diameter portion 43 of the driving shaft 38 are connected to each other is arranged on a radially inward side of the bearing portion 40. Therefore, it is possible to prevent the axial runout of the driving shaft 38 as with Embodiment 1.

By using the flexible rod 66 as above, the configuration of a rotor drive mechanism 67 can be simplified, and the rotor drive mechanism 67 can be reduced in size, weight, and cost.

In Embodiment 2, as shown in FIG. 5, the first seal portion 55 is attached to the outer peripheral surface of the rotor shaft 37. Instead of this, Embodiment 2 may be such that: the rotor shaft 37 is omitted; the first seal portion 55 is attached to an outer peripheral surface of a tip end portion of the flexible rod 66, and the axial length of the large-diameter portion 42 of the driving shaft 38 is shortened by the omission of the rotor shaft 37. In this case, the axial length of the rotor drive mechanism 67 can be shortened by the omission of the rotor shaft 37, that is, the entire length of the pump apparatus 65 can be shortened.

In Embodiments 1 and 2, the first seal portion 55 shown in FIGS. 3(*a*) and 3(*b*) is used. However, instead of this, a first seal portion 69 shown in FIGS. 4(*a*) and 4(*b*) may be used. Differences between the first seal portion 69 shown in FIGS. 4(*a*) and 4(*b*) and the first seal portion 55 shown in FIGS. 3(*a*) and 3(*b*) are a connecting wall portion 70 and the connecting wall portion 59.

Figure 4:
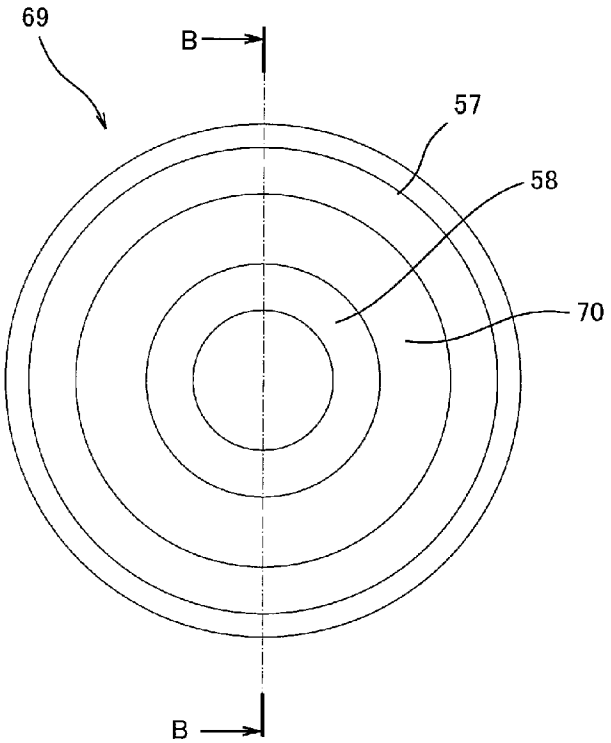
FIGS. 4(*a*) and 4(*b*) each shows another example of the first seal portion attached to the rotor drive mechanism according to Embodiment 1.
Figure 4:
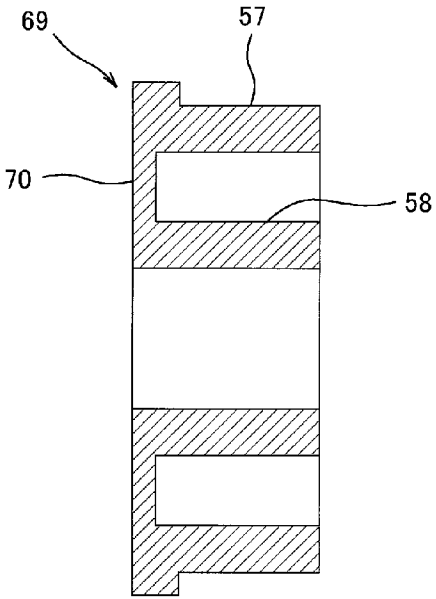

A cross-sectional shape of the first seal portion 69 shown in FIGS. 4(*a*) and 4(*b*) is a substantially C shape. The first seal portion 69 includes the outer side wall portion 57, the inner side wall portion 58, and the connecting wall portion 70. The connecting wall portion 70 is a substantially annular-shaped and plate-shaped body and connects a tip end portion of the outer side wall portion 57 and a tip end portion of the inner side wall portion 58.

In accordance with the first seal portion 69, as shown in FIG. 4(*a*), a left side surface of the first seal portion 69 faces the fluid accommodating space 36 of the first casing 28. The left side surface is formed as a flat surface by the connecting wall portion 70. Therefore, even if, for example, a high-viscosity transfer fluid in the fluid accommodating space 36 adheres to the left side surface of the first seal portion 69, the adhered fluid does not interfere with the deformation of the first seal portion 69. On this account, the rotor 22 can accurately carry out the eccentric rotational movement.

In Embodiments 1 and 2, as shown in FIG. 2 and the like, the rotating shaft 24*a* of the rotary driving portion 24 is connected to the driving shaft 38 by the coupling 45 to transfer the rotational power. However, instead of this, the rotational power of the rotating shaft 24*a* of the rotary driving portion 24 may be transferred to the driving shaft 38 by rotational power transfer means, such as gears, or timing belt pulleys and a timing belt.

In Embodiment 1, as shown in FIG. 2, the driving shaft 38 and the rotor shaft 37 are connected to each other via the second joint portion 48 (universal joint), the connecting shaft 39, and the first joint portion 47 (universal joint). However, instead of this, the driving shaft 38 and the rotor shaft 37 may be connected to each other by using an Oldham coupling (third joint portion, not shown).

In the case of using the Oldham coupling as above, for example, the rear end portion of the connecting shaft 39 and the intermediate-diameter portion 43 of the driving shaft 38 in FIG. 2 are connected to each other via the Oldham coupling.

Even in this case, as with Embodiment 1, it is possible to cause the rotor 22 to carry out the eccentric rotational movement to discharge the transfer fluid from the needle nozzle 34. Then, since there is only one joint portion, the configuration of the rotor drive mechanism 25 can be simplified, the rotor drive mechanism 25 can be reduced in size, weight, and cost, and the entire length of the pump apparatus 21 can be shortened.

Since the Oldham coupling is arranged on a radially inward side of the bearing portion 40 which rotatably supports the intermediate-diameter portion 43 of the driving shaft 38, it is possible to prevent the axial runout of the driving shaft 38, as with Embodiment 1. With this, it is possible to prevent the occurrence of the vibration of the rotor drive mechanism and lengthen the lives of the second seal portions 61 and 62.

INDUSTRIAL APPLICABILITY

As above, each of the rotor drive mechanism according to the present invention and the pump apparatus including the same has excellent effects that are the reduction in the longitudinal size of the pump apparatus, the reduction in the volume of the fluid accommodating space of the casing, and the increase in the life of the seal portion. Thus, the present invention is suitably applicable to the rotor drive mechanism and the pump apparatus including the same.

REFERENCE SIGNS LIST

21 pump apparatus
22 rotor
23 uniaxial eccentric screw pump
24 rotary driving portion
24*a* rotating shaft
25 rotor drive mechanism
26 stator
26*a* stator inner hole
27 nozzle
28 first casing
29 second casing

30 third casing
31 first opening
32 second opening
33 outer tube
34 needle nozzle
35 nut
36 fluid accommodating space
37 rotor shaft
38 driving shaft
39 connecting shaft
40 bearing portion
41 center hole of driving shaft
42 large-diameter portion of driving shaft
43 intermediate-diameter portion of driving shaft
44 small-diameter portion of driving shaft
45 coupling
46 inner space
47 first joint portion
48 second joint portion
49 coupling hole
50 connecting pin
51 connecting hole
52 seal cover
53 O ring
54 connecting tubular portion
55 first seal portion
56 plug
57 outer side wall portion
58 inner side wall portion
59 connecting wall portion
60 central axis
61, 62 second seal portion
63 radial load point
65 pump apparatus
66 flexible rod
67 rotor drive mechanism
69 first seal portion
70 connecting wall portion

The invention claimed is:

1. A rotor drive mechanism configured to transfer rotation of a driving shaft to an external screw type rotor of a uniaxial eccentric screw pump via a connecting shaft, the driving shaft being rotated such that a center thereof is located at a fixed position, wherein:

the driving shaft includes an inner space which is open toward the rotor, and the connecting shaft is inserted in the inner space;

a base end portion of the connecting shaft is connected to the driving shaft, and a tip end portion of the connecting shaft is connected to the rotor;

a first seal portion seals between an inner peripheral surface of an opening of the driving shaft, the opening being open toward the rotor, and an outer peripheral surface of a base end portion of the rotor configured to carry out an eccentric rotational movement or between the inner peripheral surface of the opening of the driving shaft and an outer peripheral surface of the connecting shaft; and the first seal portion deforms such that an inner wall portion thereof moves in a radial direction of the first seal portion and is formed such that the rotor carries out the eccentric rotational movement.

2. The rotor drive mechanism according to claim 1, wherein:

the tip end portion of the connecting shaft and the rotor are connected to each other via a first joint portion;

the base end portion of the connecting shaft and the driving shaft are connected to each other via a second joint portion; and the first and second joint portions and the connecting shaft are arranged in the inner space of the driving shaft, the inner space being sealed by the first seal portion.

3. The rotor drive mechanism according to claim 1, wherein:

the base end portion of the connecting shaft and the driving shaft are connected to each other via a third joint portion; and the third joint portion and the connecting shaft are arranged in the inner space of the driving shaft, the inner space being sealed by the first seal portion.

4. A rotor drive mechanism configured such that the second joint portion of claim 2 or the third joint portion of claim 3 is arranged on a radially inward side of a bearing portion configured to rotatably support the driving shaft.

5. The rotor drive mechanism according to claim 4, wherein a second seal portion seals between an outer peripheral surface of the opening of the driving shaft, the opening being open toward the rotor, and an inner peripheral surface of a casing of the uniaxial eccentric screw pump.

6. The rotor drive mechanism according to claim 2, wherein each of the first and second joint portions is a universal joint.

7. The rotor drive mechanism according to claim 1, wherein the connecting shaft is a flexible rod.

8. A pump apparatus comprising:

the rotor drive mechanism according to claim 1; and the uniaxial eccentric screw pump.

* * * * *